US007829513B2

(12) United States Patent
McCarthy et al.

(10) Patent No.: US 7,829,513 B2
(45) Date of Patent: Nov. 9, 2010

(54) ORGANIC CLEANING COMPOSITION

(75) Inventors: Adam McCarthy, Raleigh, NC (US); David Andrew Gordon, Lafayette, LA (US)

(73) Assignee: Greenology Products, Inc., Raleigh, NC (US)

( * ) Notice: Subject to any disclaimer, the term of this patent is extended or adjusted under 35 U.S.C. 154(b) by 0 days.

(21) Appl. No.: 12/403,044

(22) Filed: Mar. 12, 2009

(65) Prior Publication Data

US 2010/0234270 A1 Sep. 16, 2010

(51) Int. Cl.
*C11D 7/26* (2006.01)
*C11D 7/50* (2006.01)

(52) U.S. Cl. ..... 510/108; 510/180; 510/181; 510/219; 510/437; 510/487; 510/488; 510/505; 510/513

(58) Field of Classification Search ..... 510/108, 510/180, 181, 219, 223, 434, 477, 488, 513, 510/437, 487, 505
See application file for complete search history.

(56) References Cited

U.S. PATENT DOCUMENTS

| | | | | |
|---|---|---|---|---|
| 3,544,365 | A | 12/1970 | McCormick | |
| 4,501,680 | A | 2/1985 | Aszman et al. | |
| 4,541,945 | A | 9/1985 | Anderson et al. | |
| 4,587,030 | A | 5/1986 | Casey | |
| 5,108,514 | A | 4/1992 | Kisner | |
| 5,120,363 | A * | 6/1992 | Puckett | 106/209.1 |
| 5,280,042 | A * | 1/1994 | Lopes | 514/557 |
| 5,527,395 | A | 6/1996 | Perry et al. | |
| 5,750,482 | A | 5/1998 | Cummings | |
| 5,888,938 | A | 3/1999 | Lojek | |
| 5,922,672 | A | 7/1999 | Stringer et al. | |
| 5,977,050 | A | 11/1999 | Faris | |
| 6,039,892 | A * | 3/2000 | Himeshima et al. | 252/188.28 |
| 6,045,817 | A | 4/2000 | Ananthapadmanabhan et al. | |
| 6,432,826 | B1 | 8/2002 | Emami et al. | |
| 6,468,953 | B1 | 10/2002 | Hitchens et al. | |
| 6,586,470 | B1 * | 7/2003 | Lojek et al. | 514/557 |
| 6,613,376 | B2 | 9/2003 | Smith et al. | |
| 7,056,862 | B2 * | 6/2006 | Hayashi et al. | 504/116.1 |
| 7,094,742 | B2 | 8/2006 | Gaudreault | |
| 7,226,892 | B2 | 6/2007 | Henningsen | |
| 7,291,586 | B2 * | 11/2007 | Boone et al. | 510/418 |
| 2002/0187918 | A1 | 12/2002 | Urban | |
| 2003/0050204 | A1 | 3/2003 | LaGraff et al. | |
| 2005/0239043 | A1 | 10/2005 | Harding | |
| 2006/0116309 | A1 | 6/2006 | Lambotte et al. | |
| 2006/0127480 | A1 * | 6/2006 | Tobyn et al. | 424/484 |
| 2006/0217286 | A1 | 9/2006 | Geoffroy et al. | |
| 2007/0010400 | A1 | 1/2007 | Sabnis et al. | |
| 2009/0069403 | A1 * | 3/2009 | Nakano et al. | 514/423 |
| 2010/0016381 | A1 * | 1/2010 | Asakawa et al. | 514/359 |

FOREIGN PATENT DOCUMENTS

| | | | |
|---|---|---|---|
| WO | WO 03/103408 | A1 * | 12/2003 |
| WO | WO 2006118329 | A1 * | 9/2006 |
| WO | WO2007077039 | A1 | 7/2007 |
| WO | WO2008144501 | A2 | 11/2008 |

* cited by examiner

*Primary Examiner*—Lorna M Douyon
(74) *Attorney, Agent, or Firm*—Ward and Smith, P.A.

(57) ABSTRACT

An organic cleaning composition includes effective amounts of citric acid, acetic acid and malic acid. The acids are mixed into a carrier. Optionally glycerin and soybean oil may also be added to the mixture. Preferably the acids are mixed with water wherein the water is about ninety-six point five percent (96.5%) to about ninety-seven point five percent (97.5%) by weight of the mixture.

1 Claim, No Drawings

ORGANIC CLEANING COMPOSITION

FIELD OF THE INVENTION

This invention relates to organic cleaning compositions, formulations and solutions, and to methods of cleaning using such compositions, formulations and solutions. The invention also relates to methods of manufacturing such compositions, formulations and solutions. More particularly, the invention relates to such compositions; formulations and solutions used for the cleaning and/or cleansing of a number of industrial, domestic and/or communal hard surfaces. In particular, such compositions, formulations and solutions are useful as kitchen cleaners, bathroom cleaners, window cleaners, all purpose cleaners, and when applied on wipes, as all purpose wipes.

BACKGROUND OF THE INVENTION

Most commercial detergent formulations make it possible to efficiently clean industrial, domestic and/or communal hard surfaces. They are generally composed of a solution of surfactants of various ionic charges, in particular of non-ionic, anionic and cationic in nature, acids, caustics, solvents, and/or alcohols. Many of these formulations are harsh and not naturally occurring.

Other prior art detergent formulations include ammonia and various other synthetic or man made chemicals, many of which are toxic and damaging to the environment. In many cases of intensive prolonged exposure, such chemicals are toxic to those using the compositions for cleaning. Over time, the toxic effects of such compositions have become more widely known, and it has become desirable to attempt to avoid exposure to such toxic materials. However, experience has shown that existing compositions employing toxic materials provide the best cleaning action.

In accordance with the invention, the disadvantages of the prior art are avoided by providing a cleaning composition, formulation and/or solution which is safe and is made up of primarily naturally occurring ingredients.

SUMMARY OF THE INVENTION

In accordance with the invention, there is provided an organic composition, formulation, mixture, and/or solution which is safe and provides effective cleaning action on a variety of surfaces. In one embodiment, an organic composition includes an effective amount of citric acid, acetic acid and malic acid. The noted materials are mixed in a carrier, such as with water, for use as a cleaning composition. A stabilizer composition such as glycerin and soybean oil are added to provide foam texture and stability. In a more preferred aspect, the malic acid is preferably L-malic acid.

In another embodiment, the composition is useful as a glass cleaner and includes effective amounts of acetic acid and a stabilizer composition. As before, the noted materials are mixed in a carrier such as water. The stabilizer composition is preferably glycerin and soybean oil.

The invention also relates to a method of making the aforementioned compositions, mixtures, formulations and/or solutions.

DETAILED DESCRIPTION OF THE INVENTION

In accordance with the invention there is provided an organic cleaning composition, mixture, formulation and/or solution. There is provided a carrier, such as blend water, with effective amounts of citric acid, acetic acid and malic acid, preferably L-malic acid, mixed into the water. It is noted that while the terms carrier and/or "blend water" is used in connection with the term "solution", at least one of the components used is only "miscible" in water and does not go into solution. Thus, the term solution is intended to encompass all such terms as "composition", "formulation", "mixtures" and "solutions", and are used interchangeably herein. Such a solution works as a cleaning agent.

In a more preferred aspect a stabilizing composition may be added to provide foam stability and texture. Preferably, glycerin and soybean oil are added to the mixture to provide the appropriate texture and foam stability for ease of use.

While glycerin and soybean oil are preferred as the stabilizing components, other such components can be substituted in place thereof. Examples of other such components include but are not limited to: Coco Glucoside; Alkyl Polyglycoside; Cocamide DEA; Coca.

In the preferred embodiment in accordance with the invention, not including the water as the carrying agent, the citric acid is provided in an amount of about forty percent (40.0%) by weight, more preferably about forty percent (40.0%) to about forty-five percent (45.0%), even more preferably about forty-three percent (43.0%) to about forty-four percent (44.0%), and most preferably about forty-three point six percent (43.6%); the acetic acid is provided in an amount of about fifty percent (50%) by weight, more preferably about fifty-two percent (52.0%) to about fifty-three percent (53.0%), and most preferably about fifty-two point three percent (52.3%); and the malic acid is provided in an amount of about two percent (2.0%) to about four percent (4.0%) by weight, more preferably about four percent (4.0%), and most preferably about three point five percent (3.5%). Depending on the specific formulations, soybean oil and glycerin are provided in differing amounts as illustrated by the examples described hereafter. Preferably, when the noted mixtures are mixed with water, the water constitutes an amount of about ninety-six point five percent (96.5%) to about ninety-seven point five percent (97.5%) by weight of the total volume.

Generally speaking, formulations for an all purpose cleaner, kitchen cleaner and bathroom cleaner are made as follows. The procedure described is for a five hundred (500) gallon batch.

Weights are based on a specific gravity for water of eight point thirty-four (8.34) pounds per gallon. As will be apparent to those of ordinary skill in the art, adjustments can be made depending on variations in the batch size in a conventional manner.

Initially, a blending vessel is filled with two hundred and fifty (250) gallons of blend water. Stirring or circulation is initiated depending on the vessel design. Thereafter, approximately fifty-two (52) pounds (about 1.25 wt %) of citric acid in powder form is added to the blend vessel. Stirring is continued until the citric acid is completely in solution. This normally takes about twenty (20) to thirty (30) minutes.

After the citric acid is dissolved, about sixty-three (63) pounds, (about 1.50 wt %) of eighty percent (80%) acetic acid is added to the blend vessel. Stirring is continued for an additional fifteen (15) minutes.

In a laboratory, a solution of L-malic acid is prepared with about eighteen point four (18.4) grams (about 0.001 wt %) of L-malic acid dissolved in one thousand (1,000) ml of water. The mixture is stirred until the L-malic acid is completely dissolved. If the L-malic acid is in briquette form, the briquette is crushed in a mortar and pestle before adding to the water. Thereafter, L-malic acid solution is added to the blend vessel and stirring is continued for five (5) minutes.

Thereafter, in a laboratory, a solution of glycerin is prepared by adding about two (2) grams (about 0.0001 wt %) of glycerin to one thousand (1,000) ml of water. The glycerin is stirred in completely and thereafter added to the blend vessel. Stirring continues for five (5) minutes.

A solution of soy oil is then prepared in the laboratory by adding about two (2) grams (about 0.0001 wt %) of soybean oil to one thousand (1,000) ml of water. Stirring is conducted until the soybean oil is mixed in completely. Soybean oil is miscible in water, not soluble. A hazy solution will be created, as expected. The soybean oil solution is then added to the blend vessel and the stirring continued for fifteen (15) minutes.

Thereafter additional blend water is added to result in a total weight of four thousand one hundred seventy (4,170) pounds for a five hundred (500) gallon batch. Stirring is continued for fifteen (15) minutes and thereafter the batch is complete.

In preparing the solution, from a quality control perspective, the solution should be clear with no separation or settling. The pH of the solution should be about two point zero (2.0) to about four point zero (4.0), depending on water quality. After completion of the first batch, the pH is run and set as the target specification, allowing for plus or minus point three (0.3). Two (2) quarts of the completed solution is kept as a quality control sample.

In preparing a glass cleaner formulation, a similar procedure is based on a five hundred (500) gallon batch and weights are based on a specific gravity for water of eight point thirty-four (8.34) pounds per gallon as before.

A blend vessel is filled with about two hundred fifty (250) gallons of blend water. Stirring or circulation is initiated depending on the vessel design. About sixty-three (63) pounds (about 1.5 wt %) of eighty percent (80%) of acetic acid is added to the blend vessel and stirring continues for fifteen (15) minutes.

In the laboratory, a solution of glycerin is prepared by adding about two (2) grams (about 0.0001 wt %) of glycerin to one thousand (1,000) ml of water. The glycerin is stirred in completely and the glycerin solution is then added to the blend vessel and stirring continues for five (5) minutes.

In the laboratory, a solution of soybean oil is then prepared by adding about two (2) grams (about 0.0001 wt %) of soybean oil to one thousand (1,000) ml of water. The soybean oil is stirred in completely, and as before, it is noted that the soybean oil is miscible in water, not soluble. The soybean oil solution is then added to the blend vessel and stirring continues for five (5) minutes.

Additional blend water is added to a total weight of four thousand one hundred seventy (4,170) pounds amounting to five hundred (500) gallons. Stirring is continued for fifteen (15) minutes.

Although no dye is used to color the product, optionally a dye may be used for aesthetics purposes in a conventional manner known to those of ordinary skill.

One example of a dye usable in the formulation in Keyamine Turquoise G. Keyamine Turquoise G is a strong dye and is added in small increments and mixed thoroughly between additions. For the batch, the dye is weighed out in point five (0.5) gram increments and added to the blend vessel. Stirring is conducted until the dye is mixed in completely. When color is reached according to a desired specification, the final weight is recorded. In subsequent batches, one half of the recommended dosage of the color is added and stirred in. This will allow for changes in water quality.

The batch is complete either when no dye is used as described previously or after adding dye as a finishing step.

From a quality perspective, when complete the solution should be clear with no separation or settling. The pH of the solution should be about two point zero (2.0) to about four point zero (4.0) depending on water quality. After completion of the first batch, the pH should be checked and set as a specification, allowing for plus or minus point three (0.3). Two (2) quarts of completed solution should be kept as a quality control sample.

In the following examples, the previously described mixing procedures are followed as applicable, as will be well known to those of ordinary skill.

EXAMPLE I

An organic kitchen cleaner includes active components constituting ninety-six point five percent (96.5%) organic materials by weight, and includes forty-three point six percent (43.6%) by weight citric acid, fifty-two point three percent (52.3%) by weight acetic acid, three point five percent (3.5%) by weight L-malic acid, point three percent (0.3%) by weight soybean oil and point three percent (3.0%) by weight glycerin. The previously listed components are mixed into water at a ratio of twenty-eight thousandths (0.028) of a pound total components to one (1.0) pound of water in the manner previously described.

EXAMPLE II

An organic bathroom cleaner includes active components constituting ninety-six point five percent (96.5%) organic materials by weight, and includes forty-three point six percent (43.6%) by weight citric acid, fifty-two point three percent (52.3%) by weight acetic acid, three point five percent (3.5%) by weight L-malic acid, point three percent (0.3%) by weight soybean oil and point three percent (0.3%) by weight glycerin. The previously listed components are mixed into water at a ratio of twenty-eight thousandths (0.028) of a pound total components to one (1.0) pound water.

EXAMPLE III

An organic all purpose cleaner includes active components constituting ninety-six point five percent (96.5%) organic materials by weight, and includes forty-three point six percent (43.6%) by weight citric acid, fifty-two point three percent (52.3%) by weight acetic acid, three point five percent (3.5%) by weight L-malic acid, point three percent (0.3%) by weight soybean oil and point three percent (0.3%) by weight glycerin. The previously listed components are mixed into water at a ratio of twenty-eight thousandths (0.028) of a pound total components to one (1.0) pound water.

EXAMPLE IV

An organic window cleaner includes active components constituting one hundred percent (100.0%) organic materials by weight, and includes ninety-four point nine percent (94.9%) by weight acetic acid, point eight percent (0.8%) by weight soybean oil and point eight percent (0.8%) by weight glycerin. The previously listed components are mixed into water at a ratio of fifteen thousandths (0.015) of a pound organic to one (1.0) pound water.

EXAMPLE V

An organic all purpose cleaner for use with wipes includes active components constituting ninety-six point five percent (96.5%) organic materials by weight, and includes forty-three point six percent (43.6%) by weight citric acid, fifty-two point three percent (52.3%) by weight acetic acid, three point five percent (3.5%) by weight L-malic acid, point three percent (0.3%) by weight soybean oil and point three percent (0.3%) by weight glycerin. The previously-listed components are mixed into water at a ratio of twenty-eight thousandths (0.028) of a pound total solution to one (1.0) pound water. The mixture is then applied in a conventional manner onto commercially available fabrics used for all purpose hard surface cleaning wipes.

Having generally described the invention, the same will become better understood from the appended claims in which it is set forth in a nonlimiting matter.

What is claimed is:

1. An organic cleaning mixture, comprising:

effective amounts of acetic acid and at least one stabilizing compound; and a carrier having said acetic acid and at least one stabilizing compound mixed thereinto, said amounts of acetic acid and at least one stabilizing compound being sufficient to result in a formulation having commercially acceptable cleaning properties for a glass surface;

wherein said at least one stabilizing compound comprises glycerin and soybean oil and further wherein said mixture comprises about ninety-five percent (95%) by weight acetic acid, point eight percent (0.8%) by weight soybean oil and point eight percent (0.8%) by weight glycerin, mixed into water at a ratio of fifteen thousandths (0.015) of a pound to one (1.0) pound of water.

* * * * *